US005937918A

United States Patent [19]

Takeharada et al.

[11] Patent Number: 5,937,918

[45] Date of Patent: Aug. 17, 1999

[54] GAS FILLING METHOD AND FACILITY

[75] Inventors: Mitsuhide Takeharada, Tokyo; Shigeyoshi Nozawa, Osaka, both of Japan

[73] Assignee: Teisan K.K., Tokyo, Japan

[21] Appl. No.: 08/903,938

[22] Filed: Jul. 31, 1997

[30] Foreign Application Priority Data

Aug. 9, 1996 [JP] Japan ..... 8-211352

[51] Int. Cl.[6] ..... F17C 5/06; F17C 13/04

[52] U.S. Cl. ..... 141/18; 141/2; 141/3; 141/4; 141/97; 454/187

[58] Field of Search ..... 141/1, 2, 3, 4, 141/18, 91, 92, 97, 85, 89, 98; 137/357, 358, 360, 38; 454/187

[56] References Cited

U.S. PATENT DOCUMENTS

| | | | |
|---|---|---|---|
| 4,859,375 | 8/1989 | Lipisko et al. | 141/1 |
| 5,058,491 | 10/1991 | Wiemer et al. . | |
| 5,240,024 | 8/1993 | Moore et al. . | |
| 5,262,578 | 11/1993 | Hall | 588/249 |
| 5,322,095 | 6/1994 | Bolz | 141/97 |
| 5,417,236 | 5/1995 | Moore et al. | 137/15 |
| 5,584,325 | 12/1996 | Nickens et al. | 141/51 |
| 5,590,695 | 1/1997 | Siegele et al. | 141/63 |
| 5,601,107 | 2/1997 | Moore et al. | 137/15 |
| 5,735,321 | 4/1998 | Martyn et al. | 141/97 |

FOREIGN PATENT DOCUMENTS 0 660 030 6/1995 European Pat. Off. .

*Primary Examiner*—J. Casimer Jacyna
*Attorney, Agent, or Firm*—Young & Thompson

[57] ABSTRACT

A gas filling facility and method which maintains the purity of a gas to be filled. A connection of a gas supply pipe and a gas filling pipe attached on gas containers is performed in a first clean room while the storage of the gas filling pipe occurs in a second clean room. When the gas filling pipe is stored, ultra-high purity nitrogen gas is caused to flow through the inside thereof, so that the inside of the gas filling pipe remains under an extremely clean state.

3 Claims, 3 Drawing Sheets

GAS FILLING METHOD AND FACILITY

BACKGROUND OF THE INVENTION

The present invention relates to a method and facility for filling, into gas containers, high purity or ultra-high purity gas, for example, for use in the manufacture of semiconductors.

DESCRIPTION OF THE RELATED ART

As to a gas such as high purity nitrogen gas or silane gas which will be used in the manufacture of semiconductor devices, a gas filled in portable gas containers is generally used. The filling of such gas for the manufacture of semiconductor devices into the gas containers is usually performed in a gas filling facility.

In general, a conventional gas filling facility comprises a gas storage tank, where a gas to be filled is stored, and a gas supply pipe extending from said gas storage tank. In a case where a gas is filled into gas containers in such a gas filling facility, a plurality of gas containers are at first bundled on a holding frame and this bundle of gas containers is moved to the vicinity of the gas supply end of the gas supply pipe. Then, each branch pipe of a manifold is connected to the connection port of the two respective gas containers and a header pipe of the manifold is connected to the gas supply end of the gas supply pipe. By properly carrying out a valve operation, there is thereafter performed the filling of a gas into the gas containers from the gas storage tank by way of the gas supply pipe and manifold.

Such gas filling work will be preferably performed in an environment where a degree of cleanness is extremely higher in order that fouling particles are not mixed in a gas to be filled. In particular, it is necessary to maintain a gas at a higher purity in accordance with a higher integration of semiconductor devices in recent years. In a conventional gas filling facility, it is accordingly destined to make up a filling work area as a clean room, convey gas containers into this clean room, and perform the gas filling work. Further, it is destined that the inside of the clean room is also utilized as a storage area for manifolds prior to their use and the interior of the manifolds is substantially maintained at the same level as the degree of cleanness of the inside of the clean room.

As mentioned above, the inside of a clean room in a conventional gas filling facility has been used as a gas filling work area where a plurality of gas containers are conveyed in and a worker performs a gas filling, and also as a storage area for manifolds. In general, the volume of the clean room has been, therefore, considerably larger.

In a conventional gas filling facility, there is such a problem that fouling particles are easily mixed into the gas containers during the gas filling work because it is generally difficult to realize and maintain a clean space in a large volume clean room. Accordingly, fouling particles are easily deposited also on the inner surface of manifolds stored in the same clean room and they will be probably sent into the gas containers when filling the gas.

SUMMARY OF THE INVENTION

The present invention is therefore intended to provide a gas filling facility and filling method in order to solve the above-mentioned problems.

In order to achieve the aforementioned purpose, according to the present invention, a gas filling method, in which the connection end of a gas filling pipe attached on gas containers is connected to the connection end of a gas supply pipe extending from a gas supply source, and a predetermined gas is supplied and filled from the gas supply source into the gas containers by way of the gas supply pipe and the gas filling pipe, wherein the connection of the connection end of the gas supply pipe with the connection end of the gas filling pipe is performed in a through section capable of being opened and closed, whose inside is cleaned up, under such a state that the gas containers are placed outside of the through section.

According to this method, the gas containers are placed outside of a through section (for example, a clean room or box) and only the connection of the connection ends with each other is performed within the through section, and hence it is possible to make smaller the through section and it is enabled to enhance the degree of cleanness of its inside.

If it is destined that a worker enters in the through section when the connecting work is performed, a space where the worker occupies is required and hence it is preferred that the connection of the connection ends with each other is performed from the outside of the through section.

Furthermore, according to the present invention, a gas filling facility constructed such that the connection end of a gas filling pipe removably attached on gas containers is connected to the connection end of a gas supply pipe extending from a gas supply source, and a predetermined gas is supplied and filled from the gas supply source into the gas containers by way of the gas supply pipe and the gas filling pipe, comprises a first section, where a work of storing the gas filling pipe and attaching the gas filling pipe stored here to the gas containers can be performed, and whose inside will be cleaned up, a means provided in the first section for causing a curing gas to flow through the gas filling pipe stored in the first section, and a second section, where the connection end of the gas supply pipe is arranged, which has a through hole capable of being opened and closed through which the gas filling pipe can be inserted from the outside in order that the connection end of the gas filling pipe is connected to the same connection end of the gas supply pipe, and whose inside will be cleaned up.

In a case where a gas is filled by use of a facility having such a construction as mentioned above, a gas filling pipe prior to its use is first previously stored in a first section as a curing gas is caused to flow through its inside. According to such storing method, the inside of the gas filling pipe is made extremely clean. Then, empty gas containers are conveyed into the first section, the gas filling pipe is attached on the same gas containers and a blind plug is applied to its connection end. Although the gas containers with the gas filling pipe attached thereon are then conveyed out of said first section, the inside of the thus-cured gas filling pipe keeps its cleaned condition because the connection end of the gas filling pipe has the blind plug attached thereon. After the gas containers conveyed out of the first section are arranged at a position adjacent to a through hole outside of a second section and the connection end of the gas filling pipe is inserted from the through hole into the second section, the blind plug is removed therefrom and the connection end of the gas filling pipe is connected to the connection end of the gas supply pipe, whereby a gas is supplied from the gas supply source and filled into the gas containers. Since the second section is exclusively used for the connecting work, it is possible to attempt its downsizing. As a result, it becomes easy to clean up the second section and its degree of cleanness can be increased. Furthermore, it is after all possible to prevent fouling particles from invading into the gas filling pipe when the connecting work is performed.

DESCRIPTION OF THE PREFERRED EMBODIMENT

Figure 1:
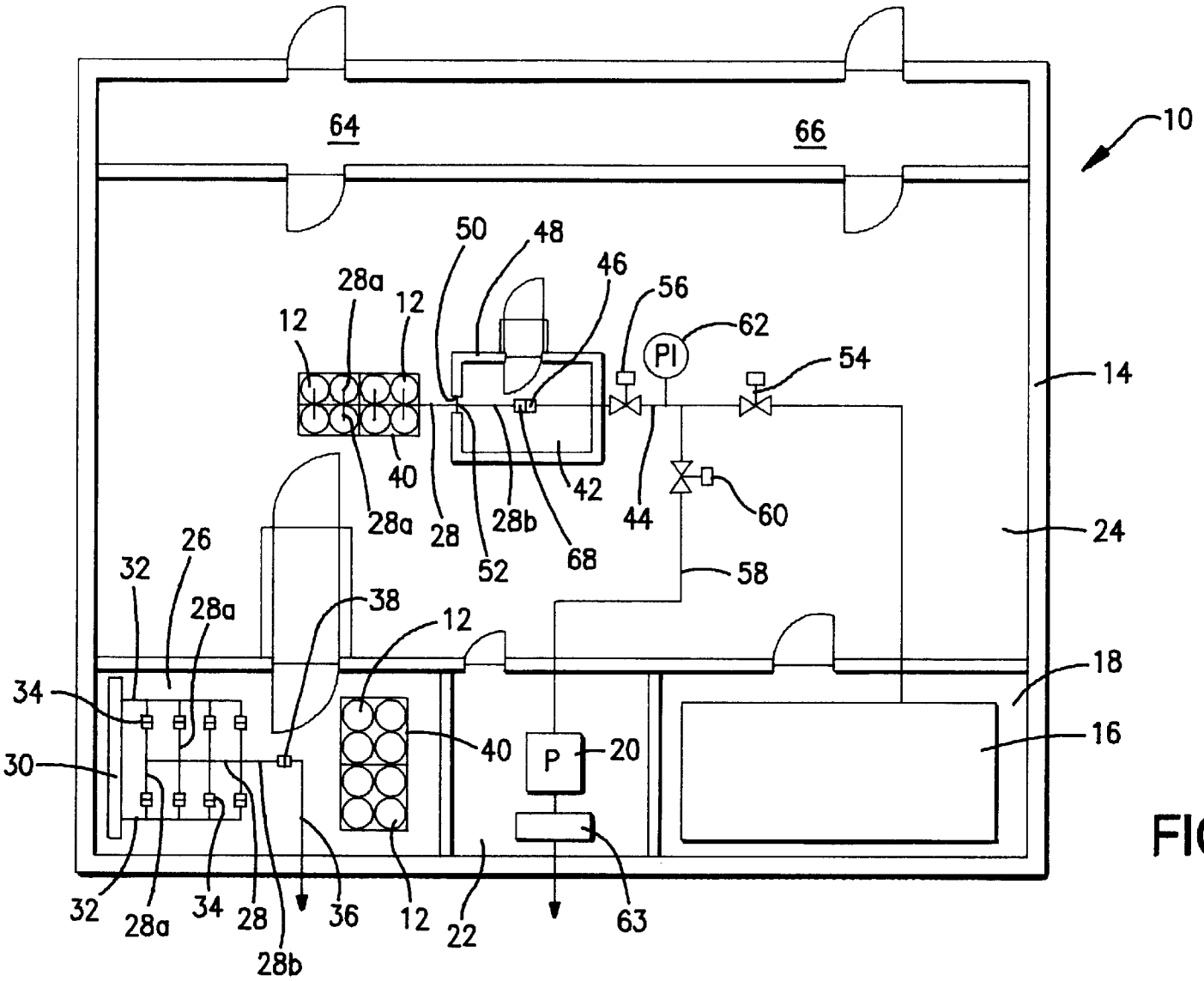
FIG. 1 is a lay-out view of schematically showing one embodiment of the gas filling facility according to the present invention.

Now referring to the accompanying drawings, a preferred embodiment of the present invention will be described in detail. In the drawings, in addition, the same or corresponding parts are given with the same reference numerals.

FIG. 1 is a lay-out view of schematically illustrating one embodiment of the gas filling facility according to the present invention. This gas filling facility 10 is of a facility for filling a high purity or ultra-high purity gas which will be used for the manufacture of semiconductor devices or the like, for example, ultra-high purity nitrogen gas or silane gas, into such portable gas containers 12 as shown in FIG. 2.

In the gas filling facility 10 as shown in FIG. 1, it is set that the inside of a facility house 14 is demarcated to a storage tank room 18, where a gas storage tank 16 for storing a gas to be filled is accommodated, a pump room 22, where a vacuum pump 20 for evacuating the gas containers 12 in vacuum when filling the gas is accommodated, and a working area 24 where a work for conveying the gas containers 12 and a work for filling the gas are performed.

The gas filling facility 10 has further a first clean room (a first section) 26. This first clean room 26 serves to store a gas filling pipe 28 to be connected with the mouth piece of the gas containers 12 when filling the gas. In the illustrated embodiment, it is destined to perform the filling of a gas into the plurality of the gas containers 12 in the mass, and hence such a movable (portable) manifold as shown in FIG. 2 is employed as the gas filling pipe 28. In the first clean room 26 are usually stored a plurality of manifolds 28. When the manifolds are stored, the end of respective branch pipes 28*a*, in each manifold, on the side of the gas containers 10 is connected to a curing gas supply pipe 32 extending from a curing gas supply unit 30 by means of a suitable connection means, for example, a union joint type connection means 34, and a head pipe 28*b* is connected to an exhaust pipe 36 by means of a similar connection means 38. This curing gas supply unit 30 serves to supply a curing inert gas such as ultra-high purity nitrogen gas. In addition, the exhaust pipe 38 extends from the first clean room 26 to the outside of the house 14. If the curing gas supply unit 30 is actuated as the manifold 28 is connected with the exhaust pipe 36, in such a construction as mentioned above, the curing as is caused to flow through the curing gas supply pipe 32, manifold 28 and exhaust pipe 36 and discharged to the outside. By virtue of this exhaust of the curing gas, the manifold 28 is being stored as it is cured so as to prevent foreign matters from being deposited in its inside.

Figure 2:
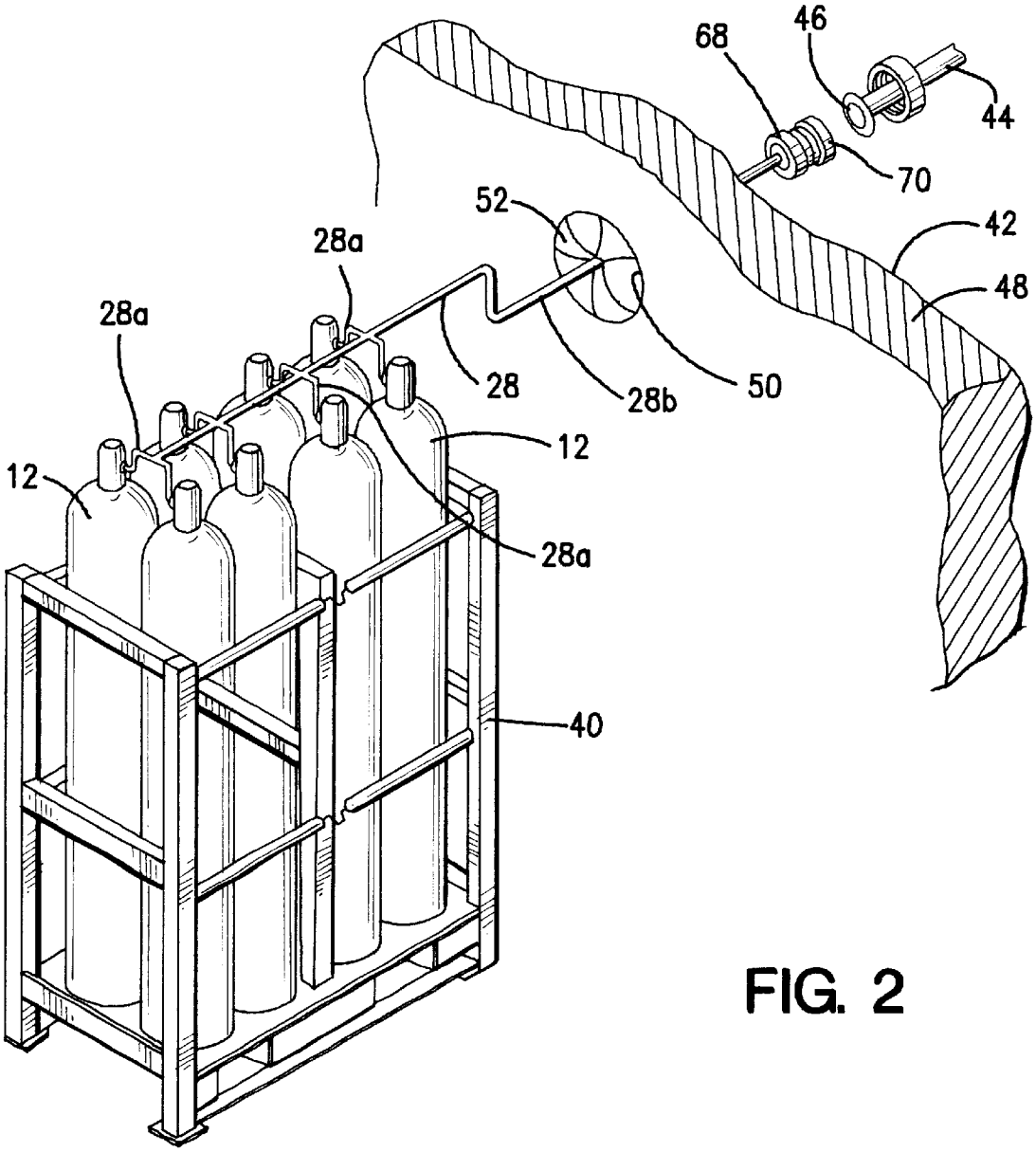
FIG. 2 is a perspective view of schematically showing a state where the manifolds attached on the plurality of the gas containers are connected to the gas supply pipe in the second clean room.

Since this first clean room 26 is used as an area for attaching the manifold 28 onto the gas containers 10 conveyed therein, it has further an additional space formed therein, where a plurality of gas containers 10 held on such a holding frame 40 as shown in FIG. 2 can be conveyed in and a worker can perform a work of attaching the manifold 28, other than a space necessary for storing the manifold 28. In order to maintain the same clean room 26 at a higher degree of cleanness, however, this additional space is preferably as small as possible.

The working area 24 has a second clean room (a through section or second section) 42 provided therein. In the second clean room 42 is disposed the connection end 46 of a gas supply pipe 44 extending from the gas storage tank 16. Preferably, this connection end 46 of the gas supply pipe 44 is disposed in the vicinity of a partition wall 48 demarcating the second clean room 42 towards the same partition wall 48.

On a portion of said partition wall 48 normally facing to the connection end 46 of the gas supply pipe 44 is formed a through hole 50. As shown in FIG. 2, this through hole 50 is made relatively smaller as the header pipe 28*a* of the manifold 28 can be inserted therein. In order to close the through hole 50 at ordinary times so that the degree of cleanness in the second clean room 42 is maintained, a closing means is provided on the through hole 50. Although there are conceived various type of closing means, for example a shut-off plate, as said closing means, a radially slit rubber plate 52 is provided on the same through hole 50 in this embodiment. The second clean room 42 is constructed such that its inside is cleaned up by pumping clean air into the room and exhausting air in the room to the outside by utilization of the internal pressure of the room, similar to a conventional general clean room. Therefore, the second clean room 42 gets, during the operation, put into such a condition as called "a normal pressure" or "a positive pressure" that is higher than the pressure of its circumference. Since the second clean room 42 assumes, during the operation, such a normal pressure condition, as mentioned above, its degree of cleanness is maintained, because the internal air is merely released to the outside and outdoor air is prevented from entering the room even if there is a little clearance therein. It is, therefore, indisputable to use the slit rubber plate 52 as the closing means for the said through hole 50.

On the gas supply pipe 44 are provided a first shut-off valve 54 and a second shut-off valve 56 which can be operated in the working area outside of the second clean room 42. The gas supply pipe 44 is connected between these first and second shut-off valves 54, 56 with an end of a vacuum exhaust pipe 58 connected at its other end with the vacuum pump 20. This vacuum exhaust pipe 58 has a third shut-off valve 60 provided thereon which can be operated in the working area 24 outside of the second clean room 42. In addition, the gas supply pipe 44 has a pressure gauge 62 preferably connected at a proper place to the side of its connection end 46, whereby the internal pressures of the gas containers 12 and gas supply pipe 44 can be monitored.

The vacuum pump 20 is preferably made operable in remote control by means of an operation panel placed outside of the second clean room 42, not shown in the drawings. In a case where a harmful gas is treated, the vacuum pump 20 has a gas treatment unit 63 provided at its exhaust port. In FIG. 1, furthermore, the reference numeral 64 represents a loading room for loading empty gas containers 12 onto the holding frame 40 and 66 represents an analysis room for examining the quality of a gas filled in the gas containers 12, and these room 64, 66 may be provided outside of the house 14.

In the next place, a procedure of filling a gas into the gas containers 12 by use of the gas filling facility 10 having the above-mentioned construction, will be described.

At first, the first and second clean rooms 26, 42 are started to operate so that the inside of the respective clean rooms 26, 42 is caused to obtain a desired degree of cleanness. And, the first, second and third shut-off valves 54, 56, 60 are left closed. Further, a plurality of manifolds 28 are previously conveyed in the first clean room 26, the respective branch pipes 28*a* thereof are connected to the curing gas supply pipes 32 of the curing gas supply unit 30 therefor and the header pipe 28*b* is connected to the exhaust pipe 36. Then, the curing gas supply unit 30 is actuated, whereby the manifolds 28 are left cured while a small amount of a curing gas such as ultra-high purity nitrogen gas is caused to continuously flow through the manifolds 28. Thus, the manifolds 28 are stored with their inside being extremely cleaned.

After such condition has been arranged, the plurality of said gas containers 12 incorporated in the holding frame 40 within the loading room 64 are conveyed from the loading room 64 into the first clean room 26 by way of the working area 24 and disposed at a predetermined position, by using, for example, a conveying unit (not shown) such as an unmanned forklift. Thereafter, the supply of a curing gas to a manifold 28 is stopped, and this manifold 28 is removed from the exhaust pipe 36 and curing gas supply pipe 32. Then, the respective branch pipe 28*a* of this removed manifold 28 are connected to mouth pieces of the gas containers 12 therefor and the blind plug 70 is attached on the connection end 68 of the header pipe 28*b* (see FIG. 2) . Since the first clean room 26 is relatively small and its inside has a considerably enhanced degree of cleanness, such a possibility is extremely smaller that floating particles in the first clean room 26 will invade into the manifold 28 during the aforementioned removing work of the manifold 28. However, this removing work of the manifold 28 will be preferably performed in a period of time as short as possible. It is a matter of course that particles are prevented from invading into the manifold 28 after the manifold 28 is attached on the gas containers 12, because the blind plug 70 is attached on the connection end 68 of the header pipe 28*b*.

By using the conveying unit, the gas containers 12 with the plurality of said manifolds are then conveyed out together with the holding frame 40 from the first clean room 26 again, and arranged in the vicinity of the through hole 50 in the working area 24 outside of the second clean room 42. At that time, the gas containers 12 are arranged so that the connection end 68 of the header pipe 28*a* of the manifold 28 extends through the through hole 50 into the second clean room 42, as shown in FIG. 2. When the gas containers 12 have been arranged as mentioned above, the header pipe 28*b* of the manifold 28 pushes and opens the rubber plate 52 of the through hole 50. Since the inside of the second clean room 42 assumes a positive pressure state and outdoor air does not enter thereinto as mentioned above, however, the degree of cleanness of the second clean room 42 does not drop.

Next, a worker enters the second clean room 42 and starts to operate a work of connecting the manifold 28 and the gas supply pipe 44. Namely, the blind plug 70 attached on the header pipe 28*b* of the manifold 28 is removed, and the connection end 46 of the gas supply pipe 44 and the connection end 68 of the heading pipe 28*b* of the manifold 28 are connected with each other through the intermediary of a gasket (not shown). Although there have bene conceived various systems as this connecting means, it is simple and preferable to connect both the connection ends 68, 46 by a union joint system. Since the amount of floating particles in the second clean room 42 which has been cleaned up is very small, a possibility of the floating particles invading into the manifold 28 is extremely small. In order to further decrease such possibility, however, it is necessary to perform the connecting work quickly.

After the connecting work of the manifold 28 and the gas supply pipe 44 is completed, the worker gets out of the second clean room 42 and thereafter performs the gas filling in the same procedure as in the prior art. Describing in detail, the second and third shut-off valves 56, 60 are caused to be placed into an opened state as the first shut-off valve 54 is closed, and the vacuum pump 20 is then started to operate, thereby placing the gas containers 12 under vacuum. After confirming, from the value of the pressure gauge 62, a fact that the gas containers 12 have reached a desired degree of vacuum, the vacuum pump 20 is stopped and the third shut-off valve 60 is closed. Thereafter, the first shut-off valve 54 is opened, whereby the gas containers 12 and the gas storage tank 16 are brought into a communicated state so that a gas in the gas storage tank 16 is caused to flow into the gas containers 12 and filled therein by virtue of a pressure difference between them. When the value of the pressure gauge 62 has reached a desired filling pressure, the first shut-off valve 54, the second shut-off valve 56 and further shut-off valves (not shown) of the respective gas containers 12 are caused to be placed into a closed state. Thereafter, in order to eliminate the remaining gas in the respective pipes 28, 44, the vacuum pump 20 is optionally started to operate as the second and third shut-off valves 56, 60 are closed. In addition, the eliminated gas will be properly treated by the gas treatment unit 63. After a condition that the vacuum pump 20 is stopped and all the shut-off valves 54, 56, 60 have got in the closed state is finally confirmed, the gas filling is completed.

After the gas filling has been completed, the worker again enters the second clean room 42 and removes the manifold 28 from the gas supply pipe 44. By taking into consideration a labor for the treatment of washing the manifold 28 left after its use, at that time, it is preferred that the connection end 68 of the manifold 28 has the blind plug attached thereon again. By use of the conveying unit, the plurality of the gas containers 12 held on the holding frame 40 are drawn apart from the second clean room 42, the header pipe 28*b* of the manifold 28 is drawn out of the through hole 50 and they are conveyed to the analysis room 66. In the analysis room 66, an analysis of the filled gas is conducted and the holding frame 40 is then disjointed. After a package for the gas containers 12 is made up, the respective gas containers 12 will be delivered to a demander which becomes a gas-using site.

In the second clean room 42, as has described above, only the connecting work of the manifold 28 and the gas supply pipe 44 and the removing work of them after the gas filling are carried out, with the gas containers 12 not conveyed therein. Accordingly, the internal space of the second clean room 42 is satisfactorily as large as a worker can enter, and hence it can be made considerably smaller, as compared with a clean room in a conventional gas filling facility, where all the works, for example, the conveyance of gas containers 12, the storage, attachment and detachment of manifolds 28 and the valve operation for gas filling, are carried out. In the case of a second clean room 42, whose volume is made as small as possible, a space having an extremely higher degree of cleanness can be obtained, even if the same cleaning unit as a conventional one is used. For instance, a conventional clean room has a degree of cleanness in an order of 1000 represented as the cleanness of American Standard. In the second clean room 42 in this embodiment, however, it becomes possible to achieve a cleanness in an order of 100.

Since the conveying work of the gas containers 12 and the valve operating work, which will cause the generation of dust, are performed outside of the second clean room 42, the degree of cleanness in the second clean 42 is always maintained at a higher level.

Since the degree of cleanness in the second clean room 42 can be maintained at an extremely high level, as mentioned above, there is a very low possibility of the floating particles invading into the manifold 28 when the connecting work of the manifold 28 is performed in the same clean room 42. Since a curing gas such as ultra-high purity nitrogen gas is caused to flow through the manifold 28 during its storage, furthermore, the number of particles deposited on the inner surface of the manifold 28 to be used is very small and is near to zero. In a case where an ultra-high purity gas is filled into the gas containers 12 under such a condition as mentioned above, accordingly, the purity of the filled gas can be effectively prevented from lowering.

A preferred embodiment of the present invention has been described above in detail, but it goes without saying that the present invention is not limited to the aforementioned embodiment. Although the aforementioned embodiment is constructed such that one kind of gas is supplied only to one group of gas containers, but such a construction may be assumed that the fore end of a gas supply pipe is branched to provide a plurality of connection ends and some groups of gas containers are connected with these respective connection ends. Furthermore, another manner may be adopted in which a plurality of gas storage tanks are provided so as to handle plural kind of gases and gas supply pipes extending from these respective gas storage tanks are disposed in a second clean room. It is a matter of course that there is no need of filling a gas into a plurality of gas containers in the mass, and such a manner may be conceived that one gas filling pipe is connected to one gas container and this gas filling pipe is inserted in a second clean room so as to be connected with a gas supply pipe. Also in a case where the gas filling is performed by use of a cardle or loader constructed such that plural (about seven to about fifty) gas containers are bundled and the mouth pieces of these respective gas containers are connected by pipes, whereby the filling and supply of a gas can be performed at one place, there can be obtained the same effects by performing in a second clean room the connection of the connection end of said cardle or loader with the connection end of said gas supply pipe.

Figure 3:
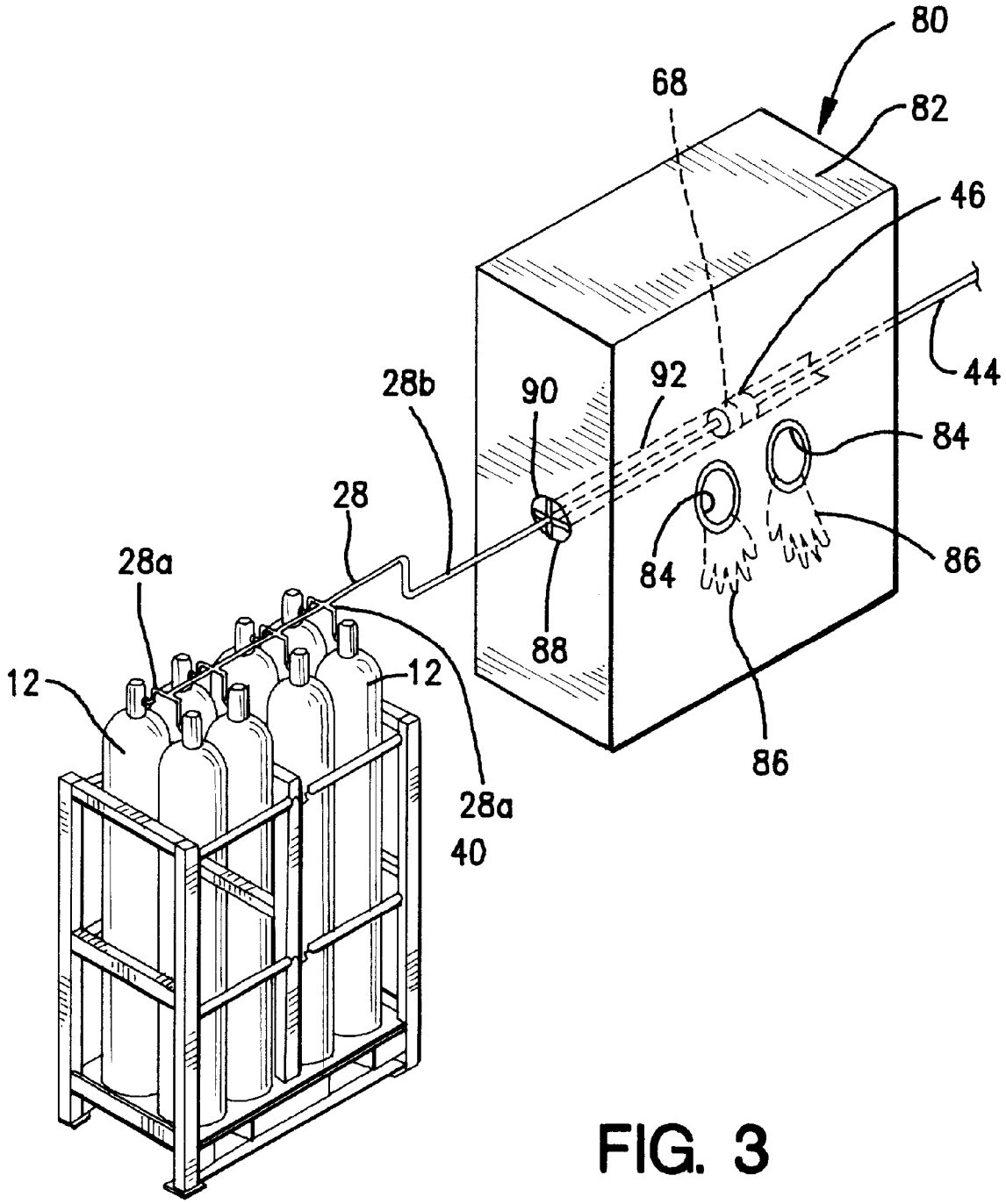
FIG. 3 is a view showing another embodiment according to the present invention, i.e. a perspective view of schematically showing a state where the manifolds attached on the plurality of said gas containers are connected to the gas supply pipe by use of the glove box.

The second clean room 42, where the connecting work is performed, may be also of another form, assuming that it is a section or vessel which can be cleaned up. In FIG. 3, there is shown, by way of example, a construction that the second clean room 42 is replaced with a glove box (a through section or second section) 80. This glove box 80 comprises a small box body 82 and gloves 86 made or rubber, which are attached on two holes 84 formed on the box body 82. A gas supply pipe 44 is attached running through one side of this box body 82, and a through hole 88, through which a manifold (a gas filling pipe) 29 coming from the gas containers 12 is to be inserted, is formed on another side thereof facing to the connection end 46 of this gas supply pipe 44. On this through hole 88 is attached a slit rubber plate 90 similarly to the second clean room 42.

In a case where such a glove box 80 is used, the inside of the glove box 80 is cleaned up by means of a suitable cleaning means and then the header pipe **28*b* of a manifold 28 connected with the gas containers 12 is inserted into the glove box 80 through the through hole 88. Thereafter, a worker wears gloves 86 on his hands and he will perform the connecting work from the outside of the glove box 80. Since even a worker, who is perhaps a contamination source, does not go in and out of the glove box 80, it becomes possible to more restrain the lowering of the degree of cleanness thereof. Furthermore, the glove box 80** is smaller than a clean room, and hence it is enabled, also from this point of view, to obtain a higher degree of cleanness, with a gas contamination-preventing effect improved.

Assuming that the connection and removal of the connection end of a gas supply pipe and the connection end of a gas filling pipe can be reliably performed, there may be also utilized, not an available installation such sa the glove box 80, a clean, small-sized box body capable of being operated from the outside by means of an equipment provided therein, for example, a magic hand. If the connection end of a gas supply pipe and the connection end of a gas filling pipe are standardized, it is enabled to guide the connection end 68, for example, along such a guide as shown at the reference numeral 92 in FIG. 3, which is provided in a clean box body, whereby the connection and removal of the connection ends with or from each other become easy.

According to the present invention, a first section for a work for storing and attaching the gas filling pipe and a second section for performing a work for connecting the gas supply pipe and the gas filling pipe are separately provided, as has been described above, and hence it becomes possible to make considerably smaller the volume of the respective sections. When the respective sections are cleaned up, their degree of cleanness can be improved, as compared with a case where a large volume section is cleaned up by a similar cleaning method. In particular, it is destined that the second section is exclusively used for the connecting work and said connecting work is performed as gas containers are placed outside of the second section, and hence an extremely higher degree of cleanness can be obtained. Owing to this fact, a possibility of fouling particles invading into the gas filling pipe becomes lower, with the purity of the filled gas prevented from lowering.

When storing the gas filled pipe, a curing gas such as ultra-high purity nitrogen gas is caused to flow through its inside, and hence the inside of the gas filling pipe gets into an extremely clean state. Furthermore, the gas filling pipe is sealed by the blind plug for a period from the attachment of the gas filling pipe to the gas containers up to the connection thereof with the gas supply pipe, and hence the clean state of the inside of the gas filling pipe is maintained. Since the degree of cleanness of the inside of the gas filling pipe connected to the gas supply pipe is considerably enhanced as compared with a conventional one, accordingly, an effect of preventing the purity of the filled gas from lowering is remarkably improved.

We claim:

1. A gas filling method, in which the connection end of a gas filling pipe removably attached on gas containers is connected to the connection end of a gas supply pipe extending from a gas supply source, and a predetermined gas is supplied and filled from said gas supply source into said gas containers by way of said gas supply pipe and said gas filling pipe, characterized by comprising:

providing a first section, whose inside is cleaned up:

providing a second section, where the connection end of said gas supply pipe is arranged, which has a through hole capable of being opened and closed, and whose inside is cleaned up:

storing said gas filling pipe prior to its use in said first section, as a curing gas is caused to flow through the inside thereof;

conveying empty gas containers into said first section, attaching said gas filling pipe to the same gas container, and applying a blind plug onto said connection end of said gas filling pipe;

conveying said gas containers having said gas filling pipe attached thereon out of said first section, and disposing the same gas containers outside of said second section at a position adjacent to said through hole; and inserting said connection end of said gas filling pipe from said through hole into said second section, removing said blind plug therefrom, and then connecting said connection end of said gas filling pipe to said connection end of said gas supply pipe, thereby performing the filling of said gas.

2. A gas filling method in which a connection end of a gas filling pipe attached to a gas container is connected to a connection end of a gas supply pipe extending from a gas supply source so that a predetermined gas may be supplied and filled from the gas supply source into the gas container via the connected gas supply pipe and the gas filling pipe, comprising the steps of:

inserting a gas filling pipe through a through hole into a through section by opening the through hole to accommodate inserting the gas filling pipe; and connecting a connection end of the gas filling pipe attached to a gas container to be filled, with a connection end of a gas supply pipe within an interior of the through section, the interior of the through section being clean, the connection end of the gas filling pipe being designed and adapted to be removably-connectable with the connection end of the gas supply pipe, wherein the gas container to be filled remains outside of the through section.

3. A gas filling method in which a connection end of a gas filling pipe attached to a gas container is connected to a connection end of a gas supply pipe extending from a gas supply source so that a predetermined gas may be supplied and filled from the gas supply source into the gas container via the connected gas supply pipe and the gas filling pipe, comprising the steps of:

inserting a gas filling pipe through a through hole into a through section by;

connecting a connection end of the gas filling pipe attached to a gas container to be filled, with a connection end of a gas supply pipe within an interior of the through section, the interior of the through section being clean, the connection end of the gas filling pipe being designed and adapted to be removably-connectable with the connection end of the gas supply pipe, wherein the gas container to be filled remains outside of the through section, and upon having filled the gas container, disconnecting the connection end of the gas filling pipe from the connection end of the gas supply pipe and removing the gas filling pipe from the through section.

* * * * *